US011250779B2

(12) United States Patent
Yang et al.

(10) Patent No.: US 11,250,779 B2
(45) Date of Patent: Feb. 15, 2022

(54) PIXEL CIRCUIT, METHOD DRIVING THE SAME AND DISPLAY DEVICE

(71) Applicant: BOE TECHNOLOGY GROUP CO., LTD., Beijing (CN)

(72) Inventors: Shengji Yang, Beijing (CN); Xue Dong, Beijing (CN); Xiaochuan Chen, Beijing (CN); Hui Wang, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 363 days.

(21) Appl. No.: 16/489,750

(22) PCT Filed: Dec. 28, 2018

(86) PCT No.: PCT/CN2018/124859

§ 371 (c)(1),
(2) Date: Aug. 29, 2019

(87) PCT Pub. No.: WO2019/214260

PCT Pub. Date: Nov. 14, 2019

(65) Prior Publication Data

US 2021/0358414 A1 Nov. 18, 2021

(30) Foreign Application Priority Data

May 8, 2018 (CN) ..... 201810430441.3

(51) Int. Cl.
*G09G 3/3258* (2016.01)

(52) U.S. Cl.
CPC ... *G09G 3/3258* (2013.01); *G09G 2300/0842* (2013.01); *G09G 2320/0238* (2013.01); *G09G 2320/066* (2013.01); *G09G 2360/144* (2013.01)

(58) Field of Classification Search
CPC ..... G09G 3/3258; G09G 3/3233; G09G 2320/066; G09G 2320/0238;
(Continued)

(56) References Cited

U.S. PATENT DOCUMENTS 8,878,756 B2 * 11/2014 Yamanaka ..... G09G 3/3233 345/82
2011/0248973 A1 * 10/2011 Kuhlman ..... G09G 3/3208 345/207

FOREIGN PATENT DOCUMENTS

WO WO-2015016007 A1 * 2/2015 ..... G09G 3/3233

* cited by examiner

*Primary Examiner* — Sardis F Azongha
(74) *Attorney, Agent, or Firm* — Brooks Kushman P.C.

(57) ABSTRACT

A pixel circuit includes a light-emitting element, a data write-in sub-circuit, a driving sub-circuit, a storage sub-circuit, a light-emission control sub-circuit, and a step-down sub-circuit. The step-down sub-circuit is configured to, at a charging compensation stage, step down a data voltage to acquire a first step-down voltage, and output the first step-down voltage via a control node. The storage sub-circuit is configured to, at the charging compensation stage, charge or discharge the control node to enable a potential at the control node to be the first step-down voltage, and at a light-emitting stage, maintain the potential at the control node as the first step-down voltage. The driving sub-circuit is configured to, at the light-emitting stage, enable a first end of the driving sub-circuit to be electrically connected to a first electrode of the light-emitting element under the control of the control node, to drive the light-emitting element to emit light.

16 Claims, 5 Drawing Sheets

(58) Field of Classification Search
CPC ... G09G 2320/0626; G09G 2300/0842; G09G 2360/144
See application file for complete search history.

PIXEL CIRCUIT, METHOD DRIVING THE SAME AND DISPLAY DEVICE

CROSS-REFERENCE TO RELATED APPLICATIONS

This application is the U.S. national phase of PCT Application No. PCT/CN2018/124859 filed on Dec. 28, 2018, which claims priority to Chinese Patent Application No. 201810430441.3 filed on May 8, 2018, which are incorporated herein by reference in their entireties.

TECHNICAL FIELD

The present disclosure relates to the field of display technology, in particular to a pixel circuit, a driving method and a display device.

BACKGROUND

For a silicon-based Organic Light-Emitting Diode (OLED) micro display device adopting both a microelectronic technique and a photoelectronic technique, it is necessary to provide high contrast in particular situations. It is difficult for a conventional pixel circuit to effectively reduce a voltage across a light-emitting element in a specific low-voltage Metal-Oxide-Semiconductor (MOS) manufacture process, so it cannot provide the high contrast.

SUMMARY

In one aspect, the present disclosure provides in some embodiments a pixel circuit, including a light-emitting element, a data write-in sub-circuit, a driving sub-circuit, a storage sub-circuit, a light-emission control sub-circuit, and a step-down sub-circuit. The data write-in sub-circuit is connected to a gate line, a data line and a data write-in node, and configured to, at a charging compensation stage, write a data voltage applied on the data line into the data write-in node under the control of the gate line. The light-emission control sub-circuit is connected to a light-emission control end, a power source voltage input end and a first end of the driving sub-circuit, and configured to, at a light-emitting stage, enable the power source voltage input end to be electrically connected to the first end of the driving sub-circuit under the control of the light-emission control end. The step-down sub-circuit is connected to the data write-in node, a control node and the power source voltage input end, and configured to, at the charging compensation stage, step down the data voltage to acquire a first step-down voltage. A first end of the storage sub-circuit is connected to the control node, and a second end of the storage sub-circuit is connected to a first voltage input end. The storage sub-circuit is configured to, at the charging compensation stage, charge or discharge the control node to enable a potential at the control node to be the first step-down voltage, and at the light-emitting stage, maintain the potential at the control node as the first step-down voltage. A control end of the driving sub-circuit is connected to the control node, and a second end of the driving sub-circuit is connected to a first electrode of the light-emitting element. The driving sub-circuit is configured to, at the light-emitting stage, enable the first end of the driving sub-circuit to be electrically connected to the first electrode of the light-emitting element under the control of the control node, to drive the light-emitting element to emit light. A second electrode of the light-emitting element is connected to a second voltage input end.

In a possible embodiment of the present disclosure, the step-down sub-circuit includes a step-down transistor, a gate electrode of which is connected to the data write-in node, a first electrode of which is connected to the power source voltage input end, and a second electrode of which is connected to the control node. The power source voltage input end is configured to input a power source voltage within a first predetermined voltage range, to enable the step-down transistor to operate at a saturation region at the charging compensation stage.

In a possible embodiment of the present disclosure, the driving sub-circuit includes a driving transistor, a gate electrode of which is connected to the control end of the driving sub-circuit, a first electrode of which is connected to the first end of the driving sub-circuit, and a second electrode of which is connected to the second end of the driving sub-circuit.

In a possible embodiment of the present disclosure, the pixel circuit further includes a switching control sub-circuit, a control end of which is connected to a switching control end, a first end of which is connected to the data write-in node, and a second end of which is connected to the control node. The switching control sub-circuit is configured to enable the data write-in node to be electrically connected to, or electrically disconnected from, the control node under the control of the switching control end.

In a possible embodiment of the present disclosure, the pixel circuit further includes a photosensing sub-circuit and a comparison sub-circuit. The photosensing sub-circuit is configured to detect an intensity of an ambient light beam. The comparison sub-circuit is configured to compare the intensity of the ambient light beam with a predetermined intensity threshold, output a first control signal to the switching control end when the intensity of the ambient light beam is smaller than or equal to the predetermined intensity threshold, and output a second control signal to the switching control end when the intensity of the ambient light beam is greater than the predetermined intensity threshold. The switching control sub-circuit is further configured to, when the first control signal has been received by the switching control end, enable the data write-in node to be electrically disconnected from the control node, and when the second control signal has been received by the switching control end, enable the data write-in node to be electrically connected to the control node.

In a possible embodiment of the present disclosure, the pixel circuit further includes a photosensing sub-circuit, a comparison sub-circuit and a voltage adjustment module. The photosensing sub-circuit is configured to detect an intensity of an ambient light beam. The comparison sub-circuit is configured to compare the intensity of the ambient light beam with a predetermined intensity threshold, output a first control signal to the voltage adjustment module when the intensity of the ambient light beam is smaller than or equal to the predetermined intensity threshold, and output a second control signal to the voltage adjustment module when the intensity of the ambient light beam is greater than the predetermined intensity threshold. The voltage adjustment module is connected to the second voltage input end and the comparison sub-circuit, and configured to step up a second voltage applied to the second voltage input end upon the receipt of the first control signal, and step down the second voltage upon the receipt of the second control signal.

In a possible embodiment of the present disclosure, the light-emitting element is a micro OLED, an anode of the micro OLED is the first electrode of the light-emitting element, and a cathode of the micro OLED is the second electrode of the light-emitting element.

In a possible embodiment of the present disclosure, the storage sub-circuit includes a storage capacitor, a first end of which is connected to the control node, and a second end of which is connected to the first voltage input end.

In a possible embodiment of the present disclosure, the pixel circuit further includes a resetting control sub-circuit, a control end of which is connected to a resetting control end, a first end of which is connected to the first electrode of the light-emitting element, and a second end of which is connected to a third voltage input end. The resetting control sub-circuit is configured to enable the first electrode of the light-emitting element to be electrically connected to, or electrically disconnected from, the third voltage input end under the control of the resetting control end.

In a possible embodiment of the present disclosure, the gate line includes a first gate line and a second gate line. The data write-in sub-circuit includes: a first data write-in transistor, a gate electrode of which is connected to the first gate line, a first electrode of which is connected to the data line, and a second electrode of which is connected to the data write-in node; and a second data write-in transistor, a gate electrode of which is connected to the second gate line, a first electrode of which is connected to the data line, and a second electrode of which is connected to the data write-in node. The first data write-in transistor is an N-type transistor, and the second data write-in node is a P-type transistor.

In another aspect, the present disclosure provides in some embodiments a method for driving the above-mentioned pixel circuit, including, at a charging compensation stage, applying a data voltage Vdata to the data line, writing, by the data write-in sub-circuit, the data voltage Vdata into the data write-in node under the control of the gate line, stepping down, by the step-down sub-circuit, the data voltage Vdata to acquire a first step-down voltage, and charging or discharging, by the storage sub-circuit, the control node to enable a potential at the control node to be the first step-down voltage.

In a possible embodiment of the present disclosure, a light-emitting stage is provided after the charging compensation stage. The method further includes, at the light-emitting stage, enabling, by the data write-in sub-circuit, the data write-in node to be electrically disconnected from the data line under the control of the gate line, maintaining, by the storage sub-circuit, the potential at the control node as the first step-down voltage, enabling, by the light-emission control sub-circuit, the power source voltage input end to be electrically connected to the first electrode of the driving sub-circuit under the control of the light-emitting control end, and enabling, by the driving sub-circuit, the first end of the driving sub-circuit to be electrically connected to the first electrode of the light-emitting element under the control of the control node to drive the light-emitting element to emit light.

In a possible embodiment of the present disclosure, the pixel circuit further includes a resetting control sub-circuit, and a resetting stage is provided before the charging compensation stage. The method further includes: at the resetting stage, enabling, by the resetting control sub-circuit, the first electrode of the light-emitting element to be electrically connected to the third voltage input end under the control of the resetting control end, so as to reset a potential at the first electrode of the light-emitting element; and at the charging compensation stage and the light-emitting stage, enabling, by the resetting control sub-circuit, the first electrode of the light-emitting element to be electrically disconnected from the third voltage input end under the control of the resetting control end.

In yet another aspect, the present disclosure provides in some embodiments a display device including the above-mentioned pixel circuit.

In a possible embodiment of the present disclosure, the display device further includes a silicon-based substrate, and the pixel circuit is arranged on the silicon-based substrate.

In a possible embodiment of the present disclosure, the silicon-based substrate is a monocrystalline silicon-based substrate.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be TFTs, field effect transistors (FETs) or any other elements having same characteristics. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

Figure 1:
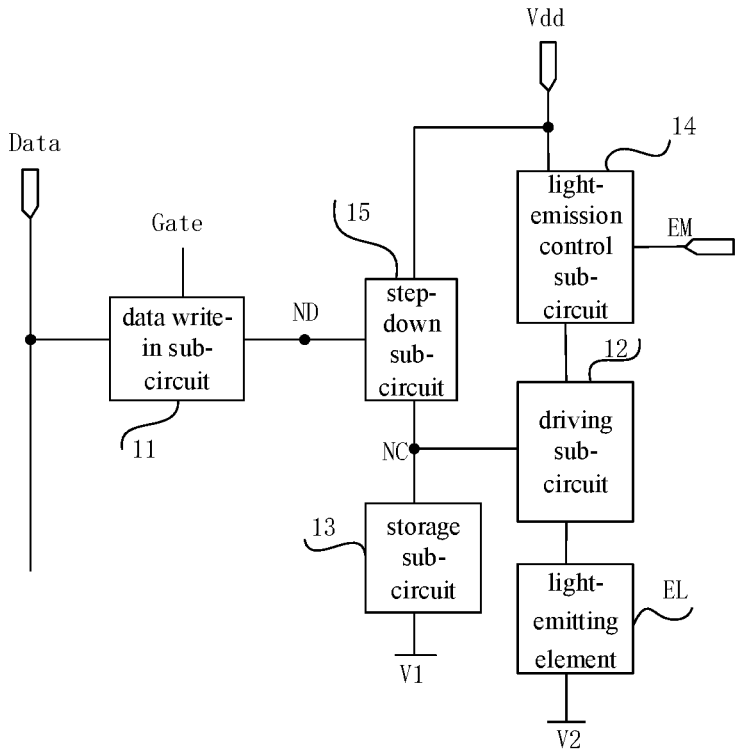
FIG. 1 is a schematic view showing a pixel circuit according to one embodiment of the present disclosure.

As shown in FIG. 1, the present disclosure provides in some embodiments a pixel circuit which includes a light-emitting element EL, a data write-in sub-circuit 11, a driving sub-circuit 12, a storage sub-circuit 13, a light-emission control sub-circuit 14, and a step-down sub-circuit 15.

The data write-in sub-circuit 11 is connected to a gate line Gate, a data line Data and a data write-in node ND, and configured to, at a charging compensation stage, write a data voltage across the data line Data into the data write-in node ND under the control of the gate line Gate.

The light-emission control sub-circuit 14 is connected to a light-emission control end EM, a power source voltage input end and a first end of the driving sub-circuit 12, and configured to, at a light-emitting stage, enable the power source voltage input end to be electrically connected to the first end of the driving sub-circuit 12 under the control of the light-emission control end EM. The power source voltage input end is configured to input a power source voltage Vdd.

The step-down sub-circuit 15 is connected to the data write-in node ND, a control node NC and the power source voltage input end, and configured to, at the charging compensation stage, step down the data voltage so as to acquire a first step-down voltage.

A first end of the storage sub-circuit 13 is connected to the control node NC, and a second end of the storage sub-circuit 13 is connected to a first voltage input end. The storage sub-circuit 13 is configured to, at the charging compensation stage, charge or discharge the control node NC so as to enable a potential at the control node NC to be the first step-down voltage, and at the light-emitting stage, maintain the potential at the control node NC as the first step-down voltage. The first voltage input end is configured to input a first voltage V1.

A control end of the driving sub-circuit 12 is connected to the control node NC, and a second end of the driving sub-circuit 12 is connected to a first electrode of the light-emitting element EL. The driving sub-circuit 12 is configured to, at the light-emitting stage, enable the first end of the driving sub-circuit 12 to be electrically connected to the first electrode of the light-emitting element EL under the control of the control node NC, so as to drive the light-emitting element EL to emit light.

A second electrode of the light-emitting element EL is connected to a second voltage input end. The second voltage input end is configured to input a second voltage V2.

According to the pixel circuit in the embodiments of the present disclosure, through the additional step-down sub-circuit 15, the potential at the control node NC at the charging compensation stage may be lower than the potential at the data write-in node ND to some extent. Through the storage sub-circuit 13, the potential at the control node NC may be charged or discharged to the first step-down voltage at the charging compensation stage, and maintained as the first step-down voltage at the light-emitting stage. As a result, it is able to reduce a potential at the first electrode of the light-emitting element EL at the light-emitting stage, and reduce a voltage across the light-emitting element EL as well as an illumination brightness value of the light-emitting element EL, thereby to improve a dark state as well as contrast of the light-emitting element EL.

In actual use, the first voltage V1 may be a low voltage, the first voltage input end may also be a common electrode voltage input end or a ground end, and the second voltage V2 may be a low voltage. However, the present disclosure shall not be limited thereto.

In the embodiments of the present disclosure, the low voltage may be, but not limited to, zero or a negative voltage smaller than 0V.

The reason why the contrast increase along with a decrease in the voltage across the light-emitting element will be described hereinafter in conjunction with the drawings.

Figure 2:
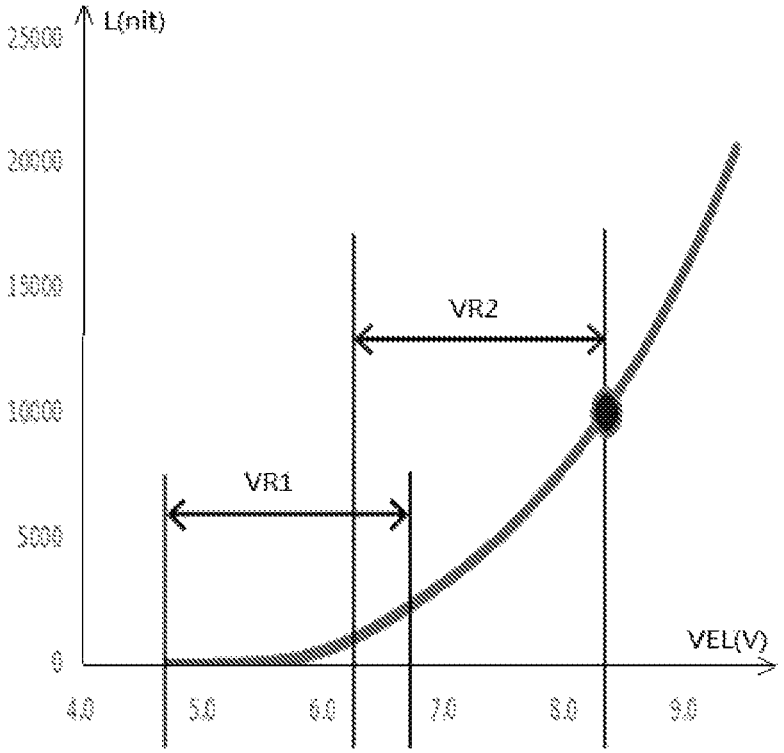
FIG. 2 is a schematic view showing a relationship between a voltage VEL across a light-emitting element and a brightness value L of the light-emitting element.

As shown in FIG. 2, an x axis represents the voltage VEL across the light-emitting element and has a unit of V, and a y axis represents a brightness value L of the light-emitting element and has a unit of nit. When VEL is within a first voltage range VR1, the light-emitting element may be in a high-contrast low-brightness mode, and when VEL is within a second voltage range VR2, the light-emitting element may be in a high-brightness low-contrast mode.

During the operation of the pixel circuit in FIG. 1, each display period may include a charging compensation stage and a light-emitting stage subsequent to the charging compensation stage.

At the charging compensation stage, the data voltage Vdata may be applied to the data line, the data write-in sub-circuit 11 may write the data voltage Vdata into the data write-in node ND under the control of the gate line Gate, the step-down sub-circuit 15 may step down the data voltage Vdata to acquire the first step-down voltage VD1, and the storage sub-circuit 13 may charge or discharge the control node NC so as to enable the potential at the control node NC to be the first step-down voltage VD1.

At the light-emitting stage, the data write-in sub-circuit 11 may control the data write-in node ND to be electrically disconnected from the data line Data under the control of the gate line Gate, the storage sub-circuit may maintain the potential at the control node NC as the first step-down voltage VD1, the light-emission control sub-circuit 14 may control the power source voltage input end to be electrically connected to the first end of the driving sub-circuit 12 under the control of the light-emission control end EM, and the driving sub-circuit 12 may control the first end of the driving sub-circuit 12 to be electrically connected to the first electrode of the light-emitting element EL under the control of the control node NC so as to drive the light-emitting element EL to emit light.

To be specific, the step-down sub-circuit may include a step-down transistor, a gate electrode of which is connected to the data write-in node, a first electrode of which is connected to the power source voltage input end, and a second electrode of which is connected to the control node. The power source voltage input end is configured to input a power source voltage within a first predetermined voltage range, so as to enable the step-down transistor to operate at a saturation region at the charging compensation stage.

In actual use, the step-down transistor may be, but not limited to, an N-type transistor.

During the implementation, the driving sub-circuit may include a driving transistor, a gate electrode of which is connected to the control end of the driving sub-circuit, a first electrode of which is connected to the first end of the driving sub-circuit, and a second electrode of which is connected to the second end of the driving sub-circuit.

In actual use, the driving transistor may be, but not limited to, an N-type transistor.

In a possible embodiment of the present disclosure, the pixel circuit may further include a switching control sub-circuit, a control end of which is connected to a switching control end, a first end of which is connected to the data write-in node, and a second end of which is connected to the control node. The switching control sub-circuit is configured to enable the data write-in node to be electrically connected to, or electrically disconnected from, the control node under the control of the switching control end.

Figure 3:
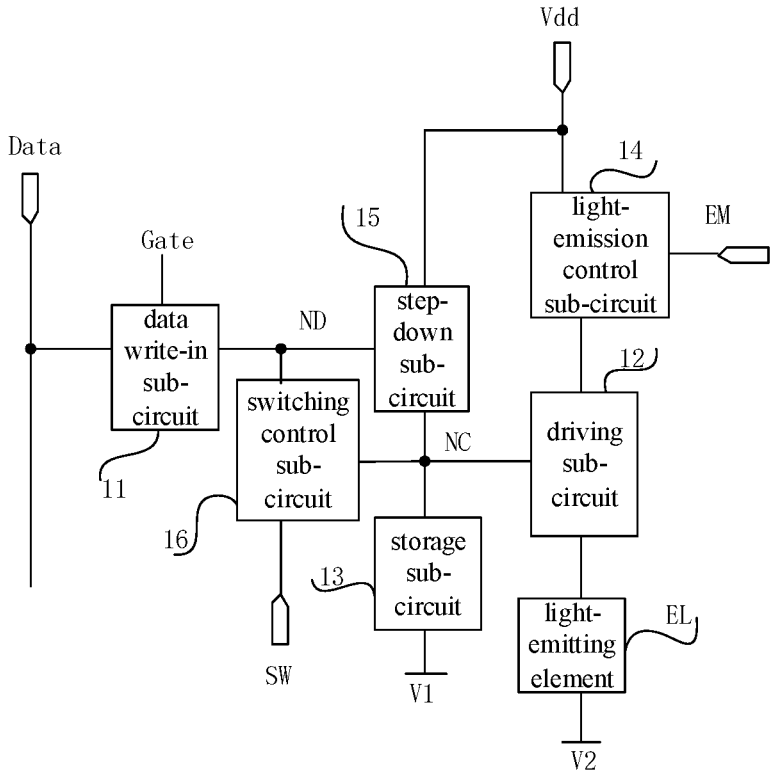
FIG. 3 is a schematic view showing the pixel circuit according to a first embodiment of the present disclosure.

As shown in FIG. 3, on the basis of the pixel circuit in FIG. 1, the pixel circuit in a first embodiment of the present disclosure may further include a switching control sub-circuit 16, a control end of which is connected to a switching control end SW, a first end of which is connected to the data write-in node ND, and a second end of which is connected to the control node NC. The switching control sub-circuit 16 is configured to enable the data write-in node ND to be electrically connected to, or electrically disconnected from, the control node NC under the control of the switching control end SW.

According to the pixel circuit in the first embodiment of the present disclosure as shown in FIG. 3, when the additional switching control sub-circuit 16 controls the data write-in node ND to be electrically disconnected from the control node NC, it is able to provide high contrast. In addition, when the switching control sub-circuit 16 controls the data write-in node ND to be electrically connected to the control node NC, it is able not to increase the contrast.

In addition, in some cases, during the operation of the pixel circuit in the first embodiment of the present disclosure as shown in FIG. 3, when the switching control sub-circuit 16 controls the data write-in node ND to be electrically connected to the control node NC, it is able to further step down the potential at the second electrode of the light-emitting element EL, thereby to provide a large brightness value. In this way, in the case of a low-voltage MOS manufacture process, it is able to provide a scheme for driving the light-emitting element EL at a high voltage.

Figure 4:
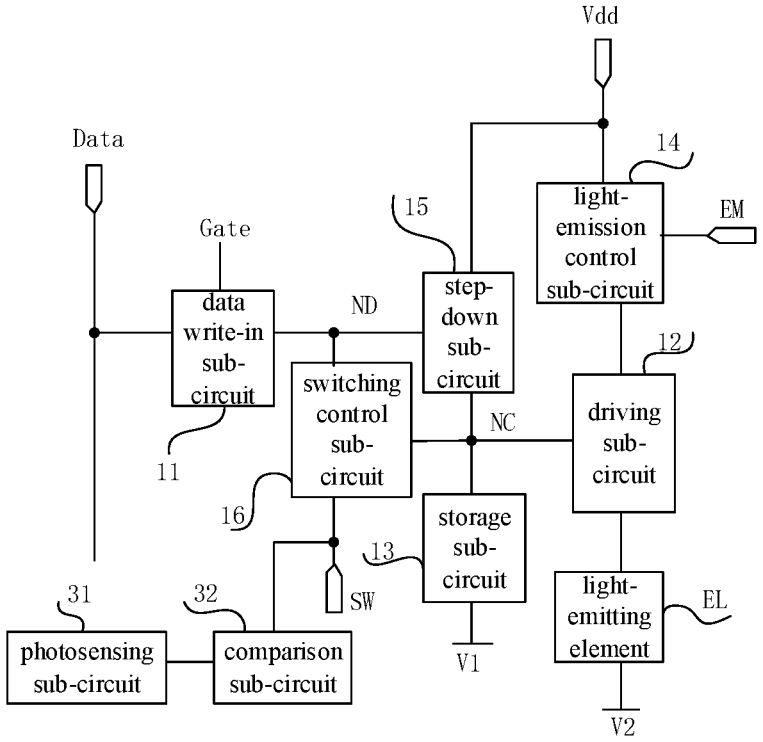
FIG. 4 is another schematic view showing the pixel circuit according to a second embodiment of the present disclosure.

In a possible embodiment of the present disclosure, on the basis of the pixel circuit in FIG. 3, as shown in FIG. 4, the pixel circuit in a second embodiment of the present disclosure may further include a photosensing sub-circuit 31 and a comparison sub-circuit 32. The photosensing sub-circuit 31 is configured to detect an intensity of an ambient light beam. The comparison sub-circuit 32 is configured to compare the intensity of the ambient light beam with a predetermined intensity threshold, output a first control signal to the switching control end SW when the intensity of the ambient light beam is smaller than or equal to the predetermined intensity threshold, and output a second control signal to the switching control end SW when the intensity of the ambient light beam is greater than the predetermined intensity threshold.

The switching control sub-circuit 16 is further configured to, when the first control signal has been received by the switching control end SW, enable the data write-in node ND to be electrically disconnected from the control node NC, and when the second control signal has been received by the switching control end SW, enable the data write-in node ND to be electrically connected to the control node NC.

In some cases, the pixel circuit in the second embodiment of the present disclosure may further include the photosensing sub-circuit 31 and the comparison sub-circuit 32. When the intensity of the ambient light beam is smaller than or equal to the predetermined intensity threshold, i.e., in a night mode, the switching control sub-circuit 16 may control the data write-in node ND to be electrically disconnected from the control node NC, so as to provide high contrast and a low brightness value. In addition, when the intensity of the ambient light beam is greater than the predetermined intensity threshold, i.e., in a daytime out-door mode, the switching control sub-circuit 16 may control the data write-in node ND to be electrically connected to the control node NC, so as to provide low contrast and a high brightness value.

During the implementation, during the operation of the pixel circuit in the second embodiment of the present disclosure as shown in FIG. 4, in the daytime out-door mode, the potential at the second electrode of the light-emitting element EL may be stepped down, so as to increase the voltage across the light-emitting element EL, thereby to provide the high brightness value.

Figure 5:
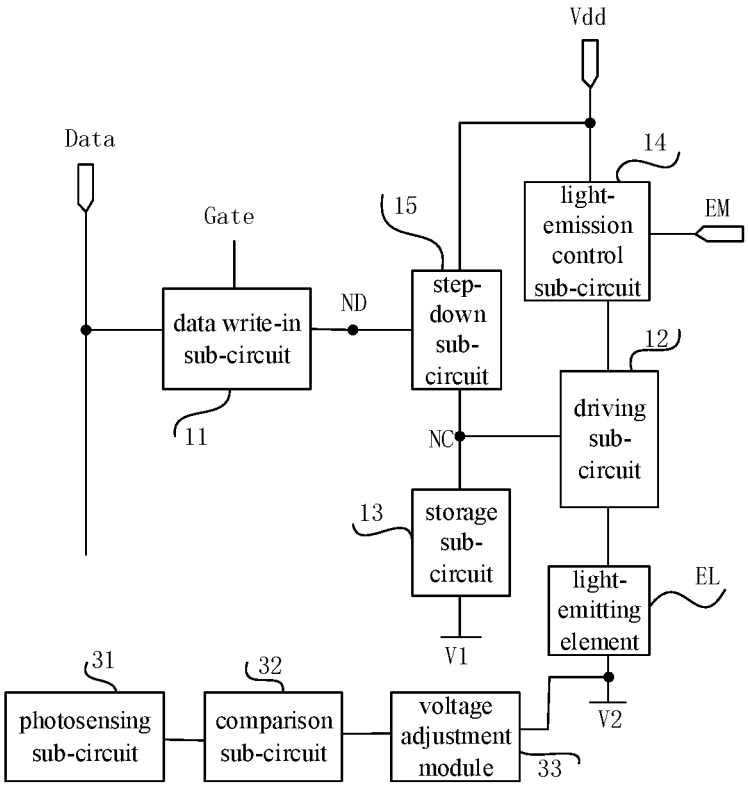
FIG. 5 is yet another schematic view showing the pixel circuit according to a third embodiment of the present disclosure.

In a possible embodiment of the present disclosure, on the basis of the pixel circuit in FIG. 1, as shown in FIG. 5, the pixel circuit in a third embodiment of the present disclosure may further include the photosensing sub-circuit 31, the comparison sub-circuit 32 and a voltage adjustment module 33. The photosensing sub-circuit 31 is configured to detect an intensity of an ambient light beam. The comparison sub-circuit 32 is further configured to output a first control signal to the voltage adjustment module 33 when the intensity of the ambient light beam is smaller than or equal to the predetermined intensity threshold, and output a second control signal to the voltage adjustment module 33 when the intensity of the ambient light beam is greater than the predetermined intensity threshold.

The voltage adjustment module 33 is connected to the second voltage input end and the comparison sub-circuit 32, and configured to step up the second voltage V2 applied to the second voltage input end upon the receipt of the first control signal, and step down the second voltage V2 upon the receipt of the second control signal.

In some cases, the pixel circuit in the third embodiment of the present disclosure may further include the photosensing sub-circuit 31, the comparison sub-circuit 32 and the voltage adjustment module 33. When the intensity of the ambient light beam is smaller than or equal to the predetermined intensity threshold, i.e., in the night mode, the voltage adjustment module 33 may step up the second voltage V2, so as to provide high contrast and a low brightness value. In addition, when the intensity of the ambient light beam is greater than the predetermined intensity threshold, i.e., in the daytime out-door mode, the voltage adjustment module 33 may step down the second voltage V2, so as to provide low contrast and a high brightness value.

In actual use, the light-emitting element EL may be an OLED. To be specific, the light-emitting element EL may be a micro OLED, a first electrode of which may be an anode, and a second electrode of which may be a cathode. However, the present disclosure shall not be limited thereto.

The micro OLED may be a silicon-based OLED micro display element with a monocrystalline silicon chip as a substrate and having a pixel size about 1/10 of a pixel size for a conventional display element, so its fineness may be far greater than that of the conventional display element.

To be specific, the storage sub-circuit may include a storage capacitor, a first end of which is connected to the control node, and a second end of which is connected to the first voltage input end.

In some cases, the pixel circuit in the third embodiment of the present disclosure may further include a resetting control sub-circuit, a control end of which is connected to a resetting control end, a first end of which is connected to the first electrode of the light-emitting element, and a second end of which is connected to a third voltage input end. The resetting control sub-circuit is configured to enable the first electrode of the light-emitting element to be electrically connected to, or electrically disconnected from, the third voltage input end under the control of the resetting control end.

During the implementation, the third voltage input end may be a low voltage input end, a ground end or a common electrode voltage input end.

Figure 6:
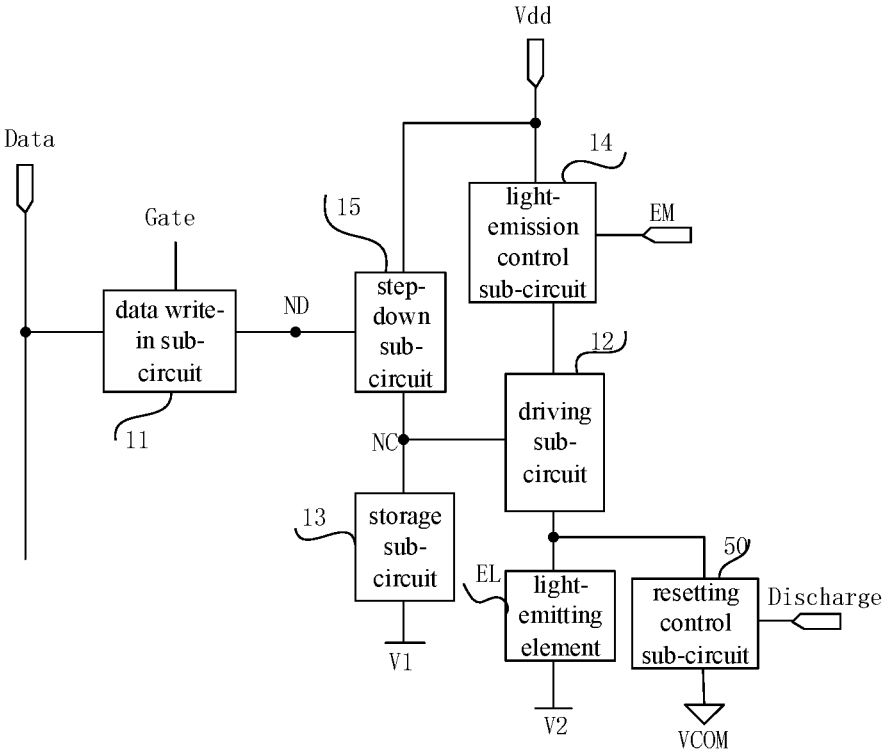
FIG. 6 is still yet another schematic view showing the pixel circuit according to a fourth embodiment of the present disclosure.

As shown in FIG. 6, on the basis of the pixel circuit in FIG. 1, the pixel circuit in a fourth embodiment of the present disclosure may further include a resetting control sub-circuit 50, a control end of which is connected to a resetting control end Discharge, a first end of which is connected to the first electrode of the light-emitting element EL, and a second end of which is connected to a common electrode voltage input end. The resetting control sub-circuit 50 is configured to, under the control of the resetting control end Discharge, enable the first electrode of the light-emitting element to be electrically connected to the third voltage input end at a resetting stage, and enable the first electrode of the light-emitting element to be electrically disconnected from the third voltage input end at the charging compensation stage and the light-emitting stage.

In FIG. 6, the third voltage input end may be a common electrode voltage input end configured to input a common electrode voltage Vcom.

According to the pixel circuit in the fourth embodiment of the present disclosure, through the additional resetting control sub-circuit 50, the first electrode of the light-emitting element EL may be electrically connected to the third voltage input end at the resetting stage prior to the charging compensation stage, so as to reset the potential at the first electrode of the light-emitting element EL to Vcom. In this way, through resetting a voltage signal from the first electrode of the light-emitting element EL within a previous frame, it is able to prevent the occurrence of motion blur when the pixel circuit is driven at a high frequency.

During the implementation, the gate line may include a first gate line and a second gate line. The data write-in sub-circuit may include: a first data write-in transistor, a gate electrode of which is connected to the first gate line, a first electrode of which is connected to the data line, and a second electrode of which is connected to the data write-in node; and a second data write-in transistor, a gate electrode of which is connected to the second gate line, a first electrode of which is connected to the data line, and a second electrode of which is connected to the data write-in node. The first data write-in transistor may be an N-type transistor, and the second data write-in node may be a P-type transistor.

In some cases, the gate line may include the first gate line and the second gate line, the first data write-in transistor may be an N-type transistor corresponding to a data voltage having a relatively small value, and the second data write-in transistor may be a P-type transistor corresponding to a data voltage having a relatively large value, so as to increase a driving voltage range for the data voltage across the data line. The pixel circuit will be described hereinafter in conjunction with the drawings.

Figure 7:
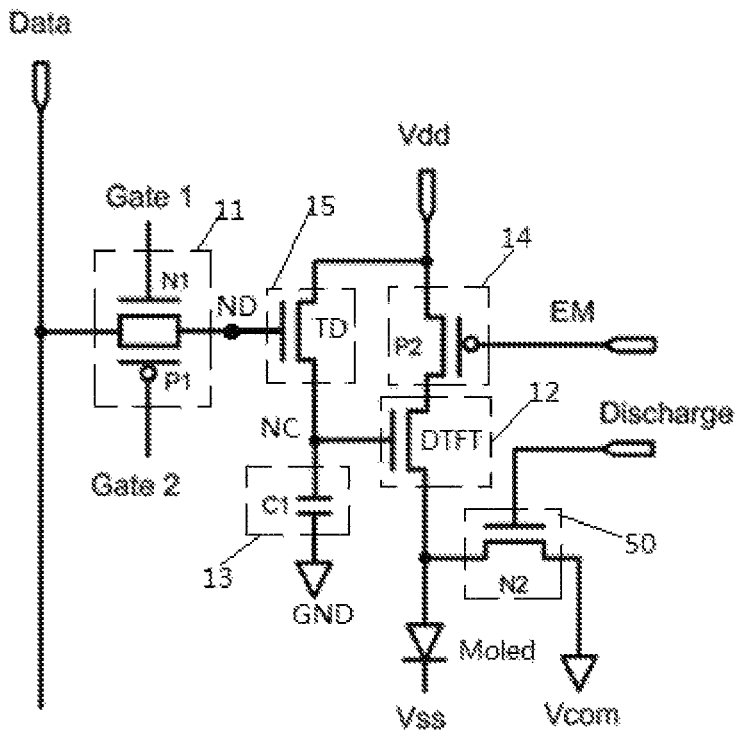
FIG. 7 is a schematic view showing the pixel circuit according to one embodiment of the present disclosure.

As shown in FIG. 7, in a possible embodiment of the present disclosure, the pixel circuit may include the micro OLED Moled, the data write-in sub-circuit 11, the driving sub-circuit 12, the storage sub-circuit 13, the light-emission control sub-circuit 14, the step-down sub-circuit 15 and the resetting control sub-circuit 50.

The data write-in sub-circuit 11 may include: a first data write-in transistor N1, a gate electrode of which is connected to the first gate line Gate1, a drain electrode of which is connected to the data line Data, and a source electrode of which is connected to the data write-in node ND; and a second data write-in transistor P1, a gate electrode of which is connected to the second gate line Gate2, a drain electrode of which is connected to the data line Data, and a source electrode of which is connected to the data write-in node ND.

The driving sub-circuit 12 may include a driving transistor DTFT, a gate electrode of which is connected to the control node NC, a drain electrode of which is connected to an anode of the micro OLED Moled. A cathode of the micro OLED Moled is configured to receive a low voltage VSS.

The storage sub-circuit 13 may include a storage capacitor C1, a first end of which is connected to the control node NC, and a second end of which is connected to a ground end GND.

The light-emission control sub-circuit 14 may include a light-emission control transistor P2, a gate electrode of which is connected to the light-emission control end EM, a source electrode of which is configured to receive a power source voltage Vdd, and a drain electrode of which is connected to a source electrode of the driving transistor DTFT.

The step-down sub-circuit 15 may include a step-down transistor TD, a gate electrode of which is connected to the data write-in node ND, a source electrode of which is configured to receive the power source voltage Vdd, and a drain electrode of which is connected to the control node NC.

The resetting control sub-circuit 50 may include a resetting control transistor N2, a gate electrode of which is connected to the resetting control end Discharge, a drain electrode of which is connected to the anode of the micro OLED Moled, and a source electrode of which is configured to receive the common electrode voltage Vcom.

In the pixel circuit in FIG. 7, N1 and N2 may be both N-type transistors, P1 and P2 may be both P-type transistors, and TD and DTFT may be both N-type transistors. However, the present disclosure shall not be limited thereto.

In actual use, when TD and DTFT are both N-type transistors, TD may operate at a saturation region at the charging compensation stage and the light-emitting stage, and DTFT may operate at a saturation region at the light-emitting stage. At this time, the pixel circuit may include a voltage-driven pixel driving circuit, i.e., an illumination brightness value of Moled may be related to a voltage difference between the anode and the cathode of Moled at the light-emitting stage. When TD and DTFT are both P-type transistors, the source electrode of TD is configured to receive Vdd and the source electrode of DTFT is also configured to receive Vdd at the light-emitting stage, so at the charging compensation stage and the light-emitting stage, TD may operate at an amplification region, and DTFT may also operate at an amplification region at the light-emitting stage. At this time, the pixel circuit may be in a current-driven mode, i.e., the illumination brightness value of Moled may be related to a driving current flowing through Moled at the light-emitting stage.

Figure 8:
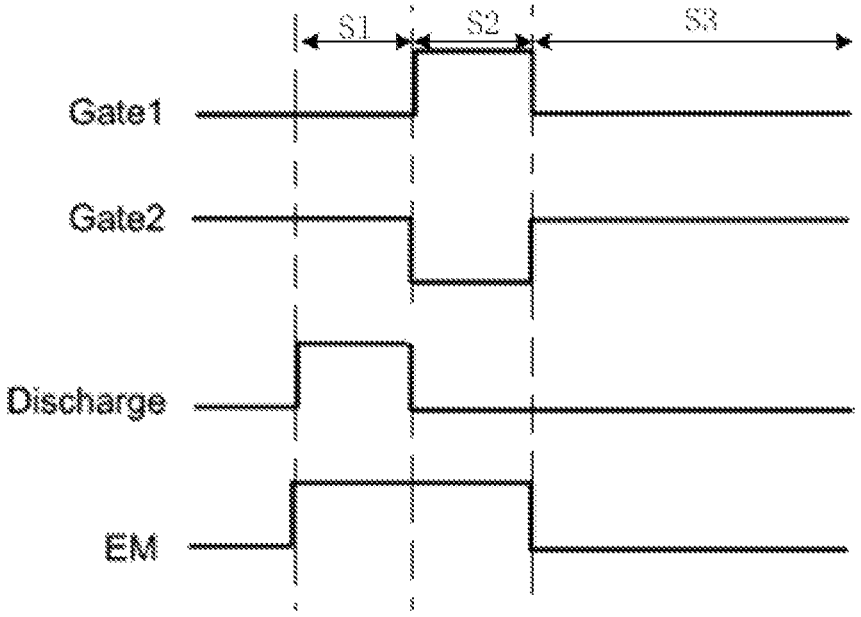
FIG. 8 is a time sequence diagram of the pixel circuit in FIG. 7.

As shown in FIG. 8, each display period may include a resetting stage S1, a charging compensation stage S2 and a light-emitting stage S3 arranged one after another.

During the operation of the pixel circuit, at the resetting stage S1, Discharge, EM and Gate2 may all output a high level, and Gate1 may output a low level, so as to turn off N1, P1, DTFT, TD and P2, and turn on N2, thereby to reset the potential at the anode of Moled to Vcom. In this way, the voltage signal applied to the anode of Moled within a previous frame may be reset, so as to prevent the occurrence of motion blur when the pixel circuit is driven at a high frequency.

At the charging compensation stage S2, Gate1 and EM may output a high level, and Gate2 and Discharge may output a low level, so as to turn on P1 and N1, and turn off N2 and P2. At this time, Data may output the data voltage Vdata, and Vdata may be written into ND, so TD may operate at the saturation region. The gate electrode of DTFT (which is connected to the control node NC) may be charged by Vdata via C1, so as to change the potential at NC to Vdata-Vth1, where Vth1 represents a threshold voltage of TD.

At the light-emitting stage S3, Gate1, Discharge and EM may output a low level, and Gate2 may output a high level, so as to turn on P2, and turn off N1, P1 and N2. At this time, DTFT and TD may each operate at the saturation region (i.e., DTFT and TD may each be a source-following transistor). The potential at NC may be maintained as Vdata-Vth1, and the potential at the anode of Moled may approach to Vdata-Vth1-Vth2 (where Vth2 represents a threshold voltage of DTFT), so the voltage applied to the anode of Moled may be stepped down twice. As compared with the related art, it is able to further reduce the voltage across Moled (i.e., a voltage difference between the anode and the cathode of Moled). At this time, it is able to reduce the illumination brightness value, and improve a dark state obviously (i.e., to provide a blacker color when Moled is in the dark state), thereby to increase the contrast of Moled.

During the operation of the pixel circuit in FIG. 7, at the charging compensation stage, TD may operate at the saturation region, and at the light-emitting stage, both TD and DTFT may operate at the saturation region (i.e., a constant current region). In addition, through the pixel circuit in FIG. 7, it is still able to provide high contrast even in the case of a specific low-voltage MOS manufacture process (e.g., a 0.11 μm, 6V manufacture process).

For the pixel circuit in FIG. 7, the threshold voltage of TD and the threshold voltage of DTFT may be each equal to 1V, and VSS may be −3V. Each transistor may be manufactured through a 6V manufacture process (i.e., a voltage difference between any two electrodes of the transistor is not greater than 6V), and Vdata may be greater than or equal to 1V and smaller than or equal to 5V. At this time, when the pixel circuit in the embodiments of the present disclosure is not adopted, the voltage across Moled may be greater than or equal to 3V and smaller than or equal to 7V. When the pixel circuit in the embodiments of the present disclosure is adopted, the voltage across Moled may greater than or equal to 2V and smaller than or equal to 6V. When the voltage across Moled is 2V, a very tiny dark-state current may flow through Moled, so it is able to increase the contrast of Moled.

In the embodiments of the present disclosure, the voltage applied to the anode of Moled may be stepped down twice through TD and DTFT, so it is able to increase the contrast of Moled.

According to the pixel circuit in the embodiments of the present disclosure, it is able to overcome the constraint caused by a current-voltage-brightness (IVL) characteristic of the light-emitting element itself in a specific predetermined environment, thereby to provide high contrast within a specific voltage withstanding range of a wafer.

Figure 9:
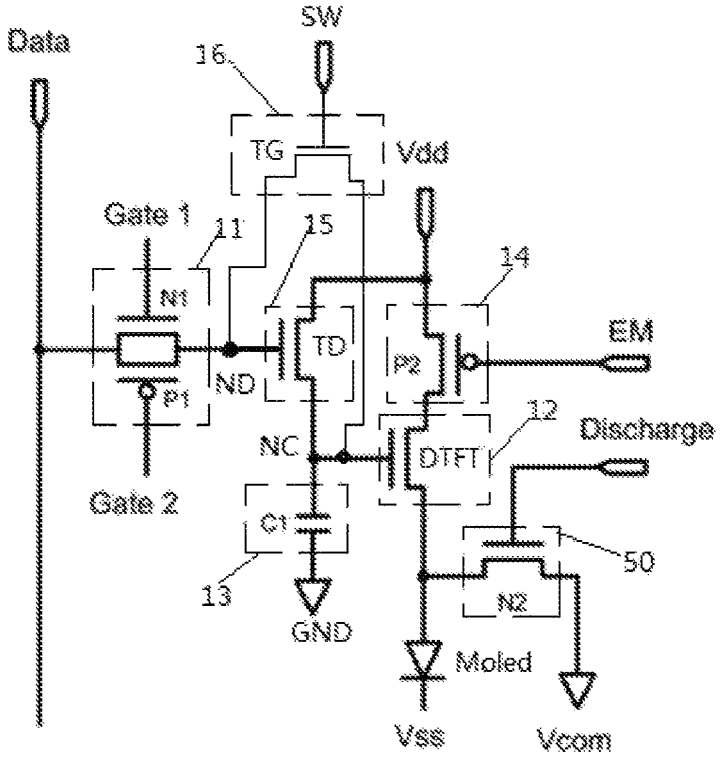
FIG. 9 is another schematic view showing the pixel circuit according to one embodiment of the present disclosure.

As shown in FIG. 9, on the basis of the pixel circuit in FIG. 6, the pixel circuit may further include the switching control sub-circuit 16. The switching control sub-circuit 16 may include a switching control transistor TG, a gate electrode of which is connected to the switching control end SW, a drain electrode of which is connected to the data write-in node ND, and a source electrode of which is connected to the control node NC.

In FIG. 9, TG may be, but not limited to, an n-type transistor.

According to the pixel circuit in the embodiments of the present disclosure, when SW outputs a high level, TG may be turned on, so as to enable ND to be electrically connected to NC, thereby not to increase the contrast. When SW outputs a low level, TG may be turned off, so as to provide the high contrast.

The present disclosure further provides in some embodiments a method for driving the above-mentioned pixel circuit which includes, at a charging compensation stage, applying a data voltage Vdata to the data line, writing, by the data write-in sub-circuit, the data voltage Vdata into the data write-in node under the control of the gate line, stepping down, by the step-down sub-circuit, the data voltage Vdata to acquire a first step-down voltage, and charging or discharging, by the storage sub-circuit, the control node so as to enable a potential at the control node to be the first step-down voltage.

According to the method in the embodiments of the present disclosure, through the step-down sub-circuit, the potential at the control node may be lower than the potential at the data write-in node to some extent at the charging compensation stage, so as to enable the potential at the control node to be the first step-down voltage. Then, the potential at the control node may be maintained by the storage sub-circuit as the first step-down voltage at the light-emitting stage. As a result, it is able to increase the contrast of the light-emitting element.

To be specific, the light-emitting stage may be provided after the charging compensation stage. The method may further include, at the light-emitting stage, enabling, by the data write-in sub-circuit, the data write-in node to be electrically disconnected from the data line under the control of the gate line, maintaining, by the storage sub-circuit, the potential at the control node as the first step-down voltage, enabling, by the light-emission control sub-circuit, the power source voltage input end to be electrically connected to the first electrode of the driving sub-circuit under the control of the light-emitting control end, and enabling, by the driving sub-circuit, the first end of the driving sub-circuit to be electrically connected to the first electrode of the light-emitting element under the control of the control node so as to drive the light-emitting element to emit light.

During the implementation, the pixel circuit may further include a resetting control sub-circuit, and a resetting stage may be provided before the charging compensation stage. The method may further include: at the resetting stage, enabling, by the resetting control sub-circuit, the first electrode of the light-emitting element to be electrically connected to the third voltage input end under the control of the resetting control end, so as to reset a potential at the first electrode of the light-emitting element; and at the charging compensation stage and the light-emitting stage, enabling, by the resetting control sub-circuit, the first electrode of the light-emitting element to be electrically disconnected from the third voltage input end under the control of the resetting control end.

According to the method in the embodiments of the present disclosure, through the additional resetting control sub-circuit, the first electrode of the light-emitting element may be electrically connected to the third voltage input end at the resetting stage prior to the charging compensation stage, so as to reset the potential at the first electrode of the light-emitting element to a third voltage. In this way, through resetting a voltage signal from the first electrode of the light-emitting element within a previous frame, it is able to prevent the occurrence of motion blur when the pixel circuit is driven at a high frequency.

The present disclosure further provides in some embodiments a display device including the above-mentioned pixel circuit.

To be specific, the display device may further include a silicon-based substrate, and the pixel circuit may be arranged on the silicon-based substrate.

The display device may be any product or member having a display function, e.g., mobile phone, flat-panel computer, television, display, laptop computer, digital photo frame or navigator.

During the implementation, the silicon-based substrate may be a monocrystalline silicon-based substrate. During the manufacture of the display device, a Complementary Metal Oxide Semiconductor (CMOS) driving circuit layer, a silicon dioxide (SiO2) layer, a pixel pattern isolation layer, a pixel pattern conductive layer (a top metal layer), a pixel anode dielectric layer (a lower electrode), an organic light-emitting layer, a transparent common cathode electrode layer (an upper electrode), a polymer and ceramic thin film encapsulation layer, a black material matrix isolation strip, a color filter strip and a glass cover plate may be arranged sequentially on the monocrystalline silicon-based substrate.

The CMOS driving circuit layer may include a pixel driving circuit, a Gate On Array (GOA) and an Integrated Circuit (IC) driving portion. The CMOS driving circuit layer may be integrated onto the monocrystalline silicon-based substrate.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel circuit, comprising a light-emitting element, a data write-in sub-circuit, a driving sub-circuit, a storage sub-circuit, a light-emission control sub-circuit, and a step-down sub-circuit;

the data write-in sub-circuit is connected to a gate line, a data line and a data write-in node respectively, and configured to, at a charging compensation stage, write a data voltage applied on the data line into the data write-in node under the control of the gate line;

the light-emission control sub-circuit is connected to a light-emission control end, a power source voltage input end and a first end of the driving sub-circuit respectively, and configured to, at a light-emitting stage, enable the power source voltage input end to be electrically connected to the first end of the driving sub-circuit under the control of the light-emission control end;

the step-down sub-circuit is connected to the data write-in node, a control node and the power source voltage input end respectively, and configured to, at the charging compensation stage, step down the data voltage to acquire a first step-down voltage;

a first end of the storage sub-circuit is connected to the control node, and a second end of the storage sub-circuit is connected to a first voltage input end;

the storage sub-circuit is configured to, at the charging compensation stage, charge or discharge the control node to enable a potential at the control node to be the first step-down voltage, and at the light-emitting stage, maintain the potential at the control node as the first step-down voltage;

a control end of the driving sub-circuit is connected to the control node, and a second end of the driving sub-circuit is connected to a first electrode of the light-emitting element;

the driving sub-circuit is configured to, at the light-emitting stage, enable the first end of the driving sub-circuit to be electrically connected to the first electrode of the light-emitting element under the control of the control node, to drive the light-emitting element to emit light; and a second electrode of the light-emitting element is connected to a second voltage input end.

2. The pixel circuit according to claim 1, wherein the step-down sub-circuit comprises a step-down transistor, a gate electrode of which is connected to the data write-in node, a first electrode of which is connected to the power source voltage input end, and a second electrode of which is connected to the control node, wherein the power source voltage input end is configured to input a power source voltage within a first predetermined voltage range, to enable the step-down transistor to operate at a saturation region at the charging compensation stage.

3. The pixel circuit according to claim 1, wherein the driving sub-circuit comprises a driving transistor, a gate electrode of which is connected to the control end of the driving sub-circuit, a first electrode of which is connected to the first end of the driving sub-circuit, and a second electrode of which is connected to the second end of the driving sub-circuit.

4. The pixel circuit according to claim 1, further comprising a switching control sub-circuit, a control end of which is connected to a switching control end, a first end of which is connected to the data write-in node, and a second end of which is connected to the control node, wherein the switching control sub-circuit is configured to enable the data write-in node to be electrically connected to, or electrically disconnected from, the control node under the control of the switching control end.

5. The pixel circuit according to claim 4, further comprising a photosensing sub-circuit and a comparison sub-circuit, wherein the photosensing sub-circuit is configured to detect an intensity of an ambient light beam;

the comparison sub-circuit is configured to compare the intensity of the ambient light beam with a predetermined intensity threshold, output a first control signal to the switching control end when the intensity of the ambient light beam is smaller than or equal to the predetermined intensity threshold, and output a second control signal to the switching control end when the intensity of the ambient light beam is greater than the predetermined intensity threshold; and the switching control sub-circuit is further configured to, when the first control signal has been received by the switching control end, enable the data write-in node to be electrically disconnected from the control node, and when the second control signal has been received by the switching control end, enable the data write-in node to be electrically connected to the control node.

6. The pixel circuit according to claim 1, further comprising a photosensing sub-circuit, a comparison sub-circuit and a voltage adjustment module, wherein the photosensing sub-circuit is configured to detect an intensity of an ambient light beam;

the comparison sub-circuit is configured to compare the intensity of the ambient light beam with a predetermined intensity threshold, output a first control signal to the voltage adjustment module when the intensity of the ambient light beam is smaller than or equal to the predetermined intensity threshold, and output a second control signal to the voltage adjustment module when the intensity of the ambient light beam is greater than the predetermined intensity threshold; and the voltage adjustment module is connected to the second voltage input end and the comparison sub-circuit respectively, and configured to step up a second voltage applied to the second voltage input end upon the receipt of the first control signal, and step down the second voltage upon the receipt of the second control signal.

7. The pixel circuit according to claim 1, wherein the light-emitting element is a micro Organic Light-Emitting Diode (OLED), an anode of the micro OLED is the first electrode of the light-emitting element, and a cathode of the micro OLED is the second electrode of the light-emitting element.

8. The pixel circuit according to claim 1, wherein the storage sub-circuit comprises a storage capacitor, a first end of which is connected to the control node, and a second end of which is connected to the first voltage input end.

9. The pixel circuit according to claim 1, further comprising a resetting control sub-circuit, a control end of which is connected to a resetting control end, a first end of which is connected to the first electrode of the light-emitting element, and a second end of which is connected to a third voltage input end, wherein the resetting control sub-circuit is configured to enable the first electrode of the light-emitting element to be electrically connected to, or electrically disconnected from, the third voltage input end under the control of the resetting control end.

10. The pixel circuit according to claim 1, wherein the gate line comprises a first gate line and a second gate line, wherein the data write-in sub-circuit comprises:

a first data write-in transistor, a gate electrode of which is connected to the first gate line, a first electrode of which is connected to the data line, and a second electrode of which is connected to the data write-in node; and a second data write-in transistor, a gate electrode of which is connected to the second gate line, a first electrode of which is connected to the data line, and a second electrode of which is connected to the data write-in node, wherein the first data write-in transistor is an N-type transistor, and the second data write-in node is a P-type transistor.

11. A method of driving the pixel circuit according to claim 1, comprising:

at a charging compensation stage, applying a data voltage Vdata to the data line, writing, by the data write-in sub-circuit, the data voltage Vdata into the data write-in node under the control of the gate line, stepping down, by the step-down sub-circuit, the data voltage Vdata to acquire a first step-down voltage, and charging or discharging, by the storage sub-circuit, the control node to enable a potential at the control node to be the first step-down voltage.

12. The method according to claim 11, wherein a light-emitting stage is provided after the charging compensation stage, wherein the method further comprises, at the light-emitting stage, enabling, by the data write-in sub-circuit, the data write-in node to be electrically disconnected from the data line under the control of the gate line, maintaining, by the storage sub-circuit, the potential at the control node as the first step-down voltage, enabling, by the light-emission control sub-circuit, the power source voltage input end to be electrically connected to the first electrode of the driving sub-circuit under the control of the light-emitting control end, and enabling, by the driving sub-circuit, the first end of the driving sub-circuit to be electrically connected to the first electrode of the light-emitting element under the control of the control node to drive the light-emitting element to emit light.

13. The method according to claim 11, wherein the pixel circuit further comprises a resetting control sub-circuit, and a resetting stage is provided before the charging compensation stage, wherein the method further comprises:

at the resetting stage, enabling, by the resetting control sub-circuit, the first electrode of the light-emitting element to be electrically connected to the third voltage input end under the control of the resetting control end, to reset a potential at the first electrode of the light-emitting element; and at the charging compensation stage and the light-emitting stage, enabling, by the resetting control sub-circuit, the first electrode of the light-emitting element to be electrically disconnected from the third voltage input end under the control of the resetting control end.

14. A display device, comprising the pixel circuit according to claim 1.

15. The display device according to claim 14, further comprising a silicon-based substrate, wherein the pixel circuit is arranged on the silicon-based substrate.

16. The display device according to claim 15, wherein the silicon-based substrate is a monocrystalline silicon-based substrate.

* * * * *